United States Patent [19]

Ballard

[11] Patent Number: 5,048,504

[45] Date of Patent: Sep. 17, 1991

[54] ARCHERY SUPPORT STAND

[76] Inventor: Jimmy D. Ballard, SSR Box 19, Weatherford, Tex. 76086

[21] Appl. No.: 493,639

[22] Filed: Mar. 15, 1990

[51] Int. Cl.[5] ..... F41B 5/00

[52] U.S. Cl. ..... 124/86; 248/122; 211/60.1; 124/23.1; 124/24.1

[58] Field of Search ..... 211/13, 60.1; 248/122; 124/23.1, 25.7, 25.6, 1, 86, 24.1

[56] References Cited

U.S. PATENT DOCUMENTS

| | | | |
|---|---|---|---|
| 2,722,958 | 11/1955 | King et al. | 211/60.1 X |
| 2,988,311 | 6/1961 | Bow | 248/122 |
| 3,286,961 | 11/1966 | Mandolare | 248/122 X |
| 3,434,638 | 3/1969 | Beynon | 124/25.7 X |
| 3,465,928 | 9/1969 | Osterholm | 124/25.7 X |
| 3,584,820 | 6/1971 | Butcher, Sr. | 124/25.7 X |
| 4,331,311 | 5/1982 | Russell | 124/23.1 X |
| 4,360,179 | 11/1982 | Roberts | 248/122 X |
| 4,474,296 | 10/1984 | Hartman | 124/23.1 X |
| 4,542,873 | 9/1985 | Matherly et al. | 124/23.1 X |
| 4,846,140 | 7/1989 | DiMartino | 124/86 X |

*Primary Examiner*—Peter M. Cuomo
*Assistant Examiner*—Carol I. Bordas
*Attorney, Agent, or Firm*—Leon Gilden

[57] ABSTRACT

An archery support stand is set forth wherein a table member includes a top surface with arrow securement plates positioned along the top surface of the table member adjacent forward side surfaces thereof with bores positioned for receiving and securing the arrows for storage. A "U" shaped bracket includes a lower pivot block with an arcuate upper face with a lock pin spaced from the arcuate forward face provided with a through-extending bore through a free end thereof for receiving a lock to latch a bow therewithin. A bifurcated clamp member positions and secures a lowermost end of the associated bow within the support stand.

3 Claims, 2 Drawing Sheets

ARCHERY SUPPORT STAND

BACKGROUND OF THE INVENTION

1. Field of the Invention

The field of invention relates to support stands, and more particularly pertains to a new and improved archery support stand wherein the same selectively secures and positions archery equipment for safe and convenient storage thereof.

2. Description of the Prior Art

The use of archery support stands is known in the prior art. Heretofore, however, the positioning of the arrows and their fragile forwardmost ends, as well as the bow in its secure position within a convenient and readily positionable support stand, has been set forth by the prior art. Examples of the prior art include U.S. Pat. No. 3,082,878 to Thomas providing an archery bow and arrow rack wherein a shelving unit receives arrows therewithin for temporary storage, as well as portions for securing a bow thereto without the locking and vertical orientation of the equipment as set forth by the instant invention.

U.S. Pat. No. 2,745,558 to Greenspan sets forth an archery support rack provided with spaced apertures for securing an arrow therewithin with multiple pegs for the hanging of a bow in a manner accessible to children and individuals not authorized to attain access to the equipment.

U.S. Pat. No. 4,621,606 to Toth sets forth an apparatus for holding a spare arrow on an archery bow providing a bracket portion securable to a mounting plate for receiving the arrows.

U.S. Pat. No. 1,472,820 to White provides for a display device provided with a series of arcuately aligned apertures set forth as cylindrical bores for receiving arrows therewithin.

U.S. Pat. No. 4,450,967 to Castor sets forth a semicylindrical display arrangement for arrows with a support stand with a central plurality of pegs for positioning a bow thereon without the security as set forth by the instant invention.

As such, it may be appreciated that there is a continuing need for a new and improved archery support stand wherein the same addresses both the problems of effectiveness in securement of archery equipment, as well as the limited access available to the equipment by unwarranted individuals.

SUMMARY OF THE INVENTION

In view of the foregoing disadvantages inherent in the known types of archery support stands now present in the prior art, the present invention provides an archery support stand wherein the same selectively latches and secures a bow member in a vertical orientation to maintain its geometric integrity, as well as positioning arrows within the stand in a secure vertical orientation while ensuring preservation of the tips of the arrows. As such, the general purpose of the present invention, which will be described subsequently in greater detail, is to provide a new and improved archery support stand which has all the advantages of the prior art archery support stands and none of the disadvantages.

To attain this, the present invention includes an archery support stand wherein the same provides for a planar supports member provided with selective brackets or leg members for securement to a support surface, as desired, with a plurality of arrow mounting plates positioned on an upper surface of the support stand positioned at opposed side edges of an upper surface of the table, wherein the arrows are positioned within tapered, resiliently aligned bores to secure the arrows therewithin while preserving the integrity of the tips of the arrows. The bow is secured at a lowermost end thereof within a bifurcated clamp and positioned overlying an arcuate surface of a pivoted support member mounted between spaced parallel arms with a locking pin spaced overlying the arcuate surface selectively locked between the parallel arms. The bifurcated bracket may optionally be formed as a pivoted clamp member to enhance securement of a lowermost end of an associated bow.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery support stand which has all the advantages of the prior art archery support stands and none of the disadvantages.

It is another object of the present invention to provide a new and improved archery support stand which may be easily and efficiently manufactured and marketed.

It is a further object of the present invention to provide a new and improved archery support stand which is of a durable and reliable construction.

An even further object of the present invention is to provide a new and improved archery support stand which is susceptible of a low cost of manufacture with regard to both materials and labor, and which accordingly is then susceptible of low prices of sale to the consuming public, thereby making such archery support stands economically available to the buying public.

Still yet another object of the present invention is to provide a new and improved archery support stand which provides in the apparatuses and methods of the prior art some of the advantages thereof, while simultaneously overcoming some of the disadvantages normally associated therewith.

Still another object of the present invention is to provide a new and improved archery support stand wherein the same selectively and vertically secures a bow and associated arrow assemblage within the support stand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
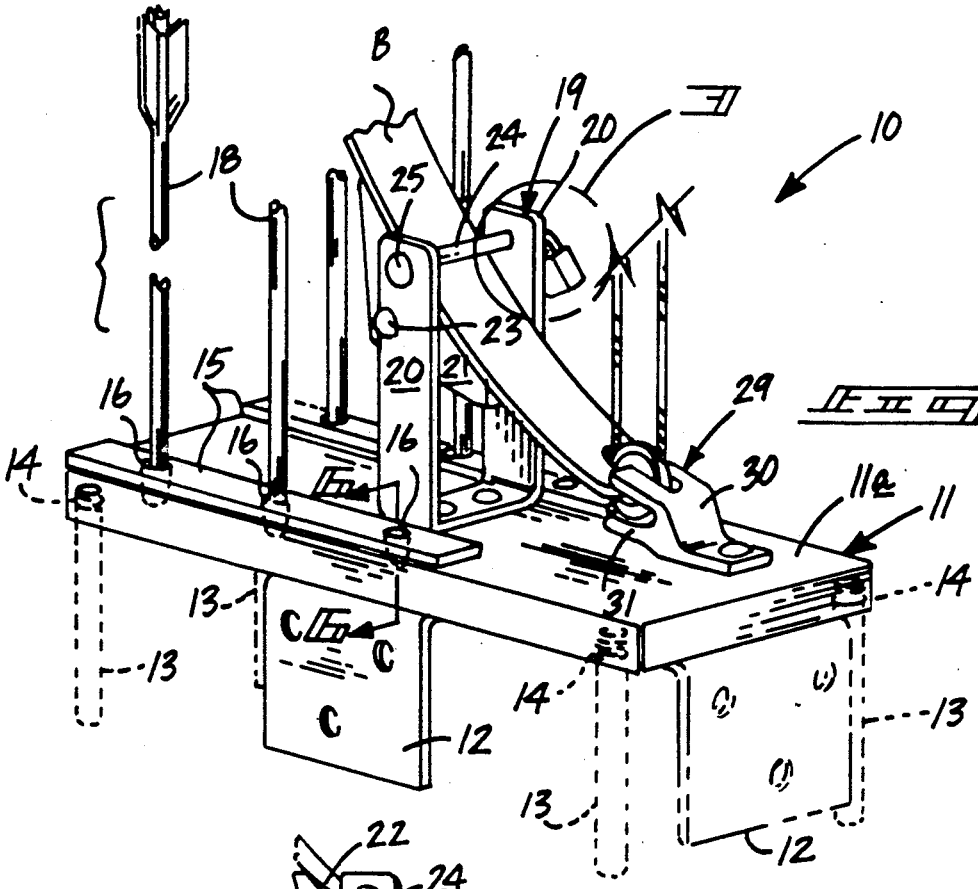
FIG. 1 is an isometric illustration of the instant invention.

With reference now to the drawings, and in particular to FIGS. 1 to 12 thereof, a new and improved archery support stand embodying the principles and concepts of the present invention and generally designated by the reference numeral 10 will be described.

More specifically, the archery support stand 10 essentially comprises a table member 11 of a generally parallelepiped configuration formed with a planar top surface 11*a*. A plurality of optional mounting plates 12 are mounted to a bottom surface of the table member 11 formed with through-extending apertures for securement to a convenient wall or support surface where optionally, leg members 13, as illustrated in phantom in FIG. 1, are threadedly receivable within threaded bores 14 positioned through a bottom surface of the table member 11 adjacent corners thereof.

A plurality of elongate arrow plates 15 are mounted to the top surface 11*a* adjacent parallel sides surfaces thereof in a spaced parallel relationship relative to one another. The arrow plates 15 are formed with tapered bores 16 that are in turn formed with a resilient liner 17 of a polymeric material laminated interiorly thereof. The liner 17 within the bore 16 protects the fragile tips of the arrows 18 positioned within the bores 16 to prevent inadvertent deformation of the tips and maintain the proper trajectory of the arrows in use.

The arrow plates 15 are also threaded 39 (FIG. 7) to accept a stabilizer 38 thereby storing the stabilizer 38 and protecting its threaded end for mounting to the bow "B".

Figure 2:
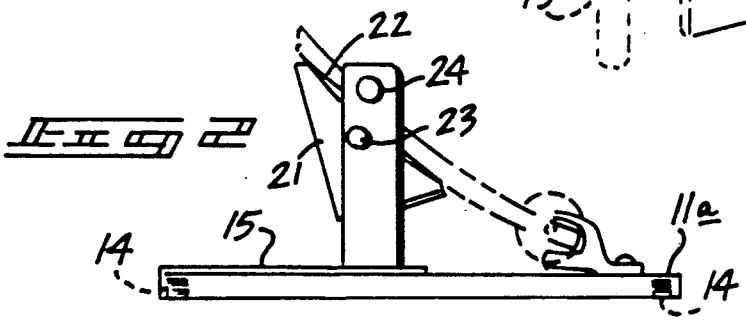
FIG. 2 is an orthographic side view taken in elevation of the bow supporting brackets.
Figure 4:
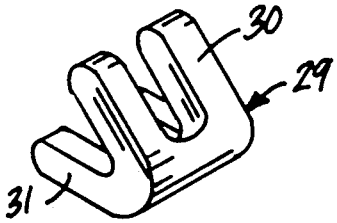
FIG. 4 is an isometric illustration of the bow positioning clamp of the instant invention.

A "U" shaped support mount 19 is mounted medially of the top surface 11*a* between the mounting plates 12 and is formed with parallel spaced leg members 20. The leg members 20 are formed with a first pair of through-extending apertures to receive a pivot axle 23 mounted therethrough, wherein the pivot axle 23 is mounted orthogonally through a support block 21. The support block 21 is formed with an upper arcuate surface 22. The upper arcuate surface 22 is configured and padded for receiving a forward surface of an archery bow "B", as illustrated in FIGS. 1 and 2 for example. The pivotment of the support axle accommodates various contours and positions of a bow "B" mounted thereon. A lock pin 24 of a length greater than the spacing between the legs 20 includes a further pair of apertures 24*a* in an aligned relationship relative to one another to receive the lock pin 24 therethrough. The lock pin 24 is formed with an enlarged head 25 at one end thereof of a diameter greater than the diameter of the further apertures 24*a* and is formed with a projecting free end 26 formed with a pin aperture 27 orthogonally therethrough to in turn receive a lock 28 through the pin aperture 27 to prevent withdrawal of the lock pin 24 from the support mount 19 and thereby capture a bow "B" therebetween and prevent its removal due to the bow "B" being captured between the lock pin 24, the support block 21, and the bow cable mounted through opposed terminal ends of the bow "B" in a conventional manner. The lowermost end of the bow "B" is secured within a positioning clamp 29 formed with upper and lower bifurcated jaws 30 and 31. The bifurcated jaws thereby form a gap to receive a conventional lowermost end of bow "B" or, as illustrated in FIG. 1, a lower pulley of conventional compound bow construction.

Figure 5:
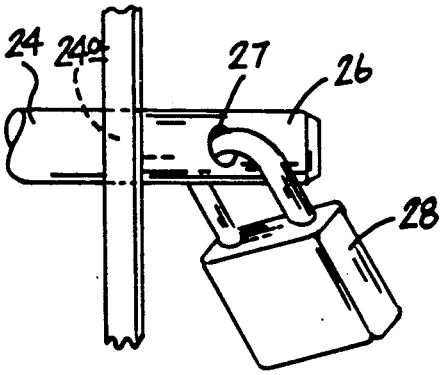
FIG. 5 is an isometric illustration of a modified positioning clamp of the instant invention.
Figure 3:
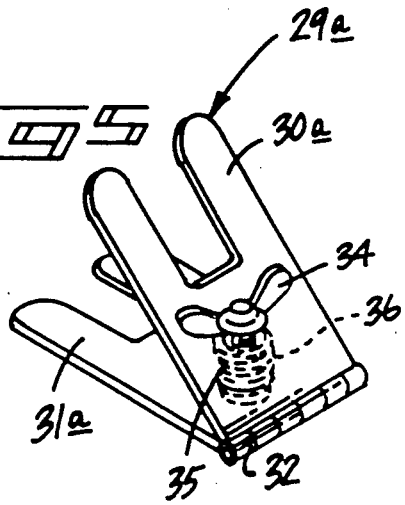
FIG. 3 is an orthographic view taken in elevation of section 3 as set forth in FIG. 1.
Figure 6:
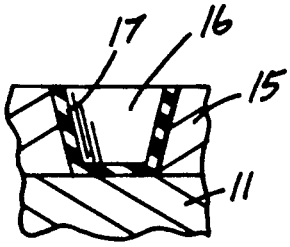
FIG. 6 is an orthographic view taken along the lines 6—6 of FIG. 1 in the direction indicated by the arrows.

FIG. 5 illustrates a modified positioning clamp 29*a* formed with spaced upper and lower bifurcated jaws 30*a* and 31*a* respectively, wherein a threaded lock member 33 is directed slidably through a bore in the upper bifurcated jaw 30 and threadedly mounted within a threaded bore 35 formed through the lower bifurcated jaw 31*a* to direct the two jaws together and clamp and secure a lowermost end of the bow "B" therebetween. A coil spring 36 captured between the upper and lower bifurcated jaws 30*a* and 31*a* about the shank of the threaded lock member 33 maintains the upper and lower jaws 30*a* and 31*a* in a normally spread orientation.

Figure 7:
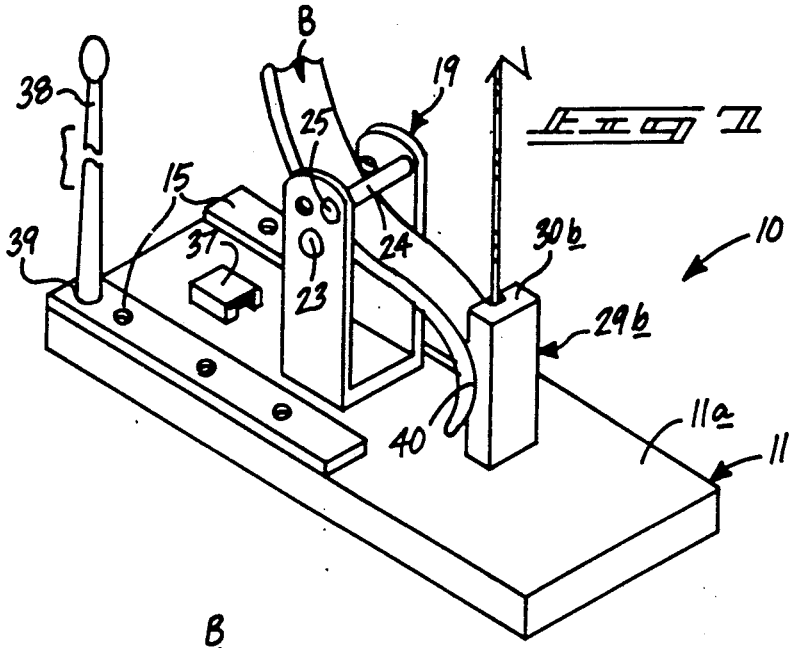
FIG. 7 is an isometric illustration of the instant invention as it relates to a recurve or compound-recurve bow.
Figure 8:
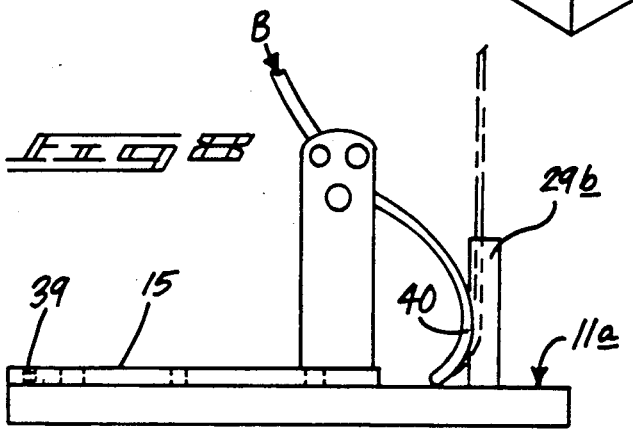
FIG. 8 is an orthographic side view taken in elevation of the bow supporting brackets for a recurve bow in its strung position.
Figure 9:
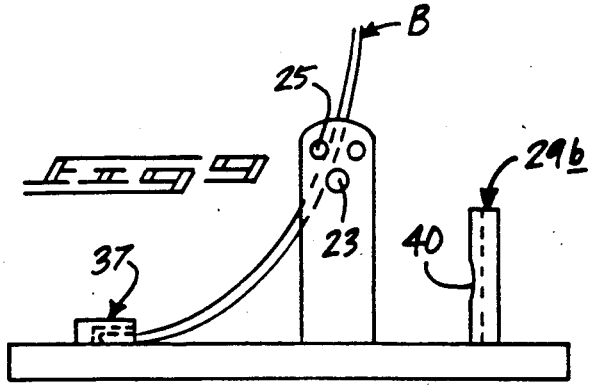
FIG. 9 is an orthographic side view taken in elevation of the bow supporting brackets for a recurve bow in its unstrung position. (The arrow plates 15 have been removed for clarity.).

FIGS. 7, 8, and 9 illustrate a modified positioning clamp 29*b* for recurve bows, the clamp 29*b* is formed with a vertical block with bifurcated jaws 30*b*. The bifurcated jaws thereby form a gap to receive a string attached to the lowermost end of bow "B". The positioning clamp 29*b* is also formed with a forward arcuate surface 40 on one face. The arcuate surface 40 is configured for receiving the backward lower end of the recurve bow when strung, as illustrated in FIGS. 7 and 8 for example.

Figure 10:
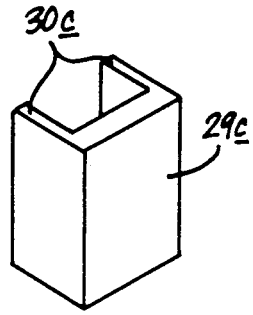
FIG. 10 is an isometric illustration of a modified positioning clamp of the instant invention for a recurve bow.

FIG. 10 illustrates a modified positioning clamp 29*c* formed with a vertical block with bifurcated jaws 30*c*. The bifurcated jaws thereby form a gap of a sufficient width to allow the lowermost end of a recurve or compound recurve bow to fit between them. Thereby securing the lower end of the bow in the stand.

Figure 11:
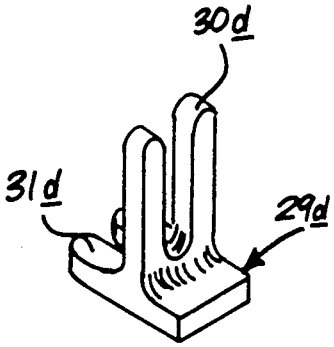
FIG. 11 is another isometric illustration of a modified positioning clamp of the instant invention for a recurve or compound-recurve bow.

FIG. 11 illustrates a modified positioning clamp 29*d* formed with spaced upper and lower bifurcated jaws 30*d* and 31*d* respectively, wherein the lower bifurcated jaws 30*d* and 31*d* form a gap to receive a conventional lower pulley of a conventional compound recurve bow construction.

FIG. 9 illustrates a tip positioning clamp 37 formed with a concaved bracket allowing the tip of the lowermost end of a conventional recurve bow "B" to fit in; thereby, securing the recurve bow "B" to the stand 10 when the bow "B" is unstrung.

Figure 12:
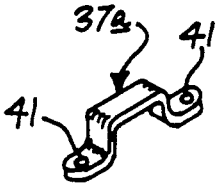
FIG. 12 is an isometric illustration of a modified bow tip positioning bracket of the instant invention for a recurve bow.

FIG. 12 illustrates a modified bow tip positioning clamp formed with bifurcated legs which in turn are bent outward on the lower ends horizontal and drilled vertically 41 in each leg to facilitate mounting to table member 11 for securing lowermost tip of recurve bow "B" when stored in the unstrung position.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery support stand for securing a plurality of arrows and an archery bow, comprising in combination, a table member including an upper surface with spaced parallel sides, with first and second arrow mounting plates for vertically mounting the plurality of arrows thereon, wherein the first and second mounting plates are mounted upon the upper surface of the table member in a spaced relationship relative to one another;

an archery bow clamp means mounted to the upper surface of the table member for securing an upper portion of the archery bow, and a positioning clamp mounted on the upper surface of the table member spaced from the clamp means and in alignment with the clamp means for receiving a lower end of the archery bow, wherein the positioning clamp includes a plurality of spaced jaws defining a gap therebetween for receiving the lower end of the archery bow;

wherein the first and second arrow mounting plates include plate members formed with a series of tapered bores directed orthogonally downwardly from an upper surface of the first and second plate members, wherein the bores are tapered and extend downwardly including a resilient polymeric liner laminated interiorly of the bores for protecting and securing arrow heads of the arrows therewithin while maintaining the arrows in a vertically aligned relationship relative to one another;

wherein the mounting plates are spaced adjacent the side walls at a forwardmost portion of the upper surface of the table member;

wherein the archery bow clamp means comprises a "U" shaped bracket mounted on the upper surface between the plate members, the bracket including spaced parallel legs, wherein the spaced parallel legs are formed with a first pair of bores with a single bore directed through each leg of the bracket, and a pivot pin mounted through the bores, wherein the pivot pin includes a support block rotatably mounted on the pivot pin, wherein the pivot block includes an upper arcuate surface for receiving an upper arcuate portion of the archery bow, and the clamp means further including a lock pin spaced above and adjacent the arcuate surface with the lock pin directed through a further pair of bores with a single bore directed through each leg of the bracket in aligned relationship relative to one another, the further bores slidably receiving a lock pin therethrough with the lock pin formed with an enlarged head at one end and a pin aperture through its other free end, the lock pin defined by a predetermined length greater than a length between the legs of the bracket, wherein an aperture of the pin extends exteriorly of the bracket orthogonally relative thereto for receiving a lock member to selectively secure the lock pin relative to the bracket.

2. An archery support stand as set forth in claim 1 wherein the spaced jaws of the positioning clamp define an upper jaw and a lower jaw, the upper jaw and the lower jaw are each bifurcated to define an upper slot within the upper jaw and lower slot within the lower jaw, wherein the upper slot and the lower slot are in aligned relationship relative to one another.

3. An archery support stand as set forth in claim 2 wherein the upper jaw is hingedly mounted to the lower jaw and includes a threaded lock member directed slidably through the upper jaw, wherein the threaded lock member includes an enlarged head formed exteriorly of the upper jaw and includes a threaded shank received within a threaded bore of the lower jaw for selectively directing the upper and lower jaws together, and a coil spring captured between the upper jaw and lower jaw wound about the shank of the threaded lock member.

* * * * *